US005133540A

United States Patent [19]

Suzuki et al.

[11] Patent Number: 5,133,540

[45] Date of Patent: Jul. 28, 1992

[54] SHEET PICKING-UP DEVICE

[75] Inventors: Tomosaburo Suzuki, Tsukui; Mitsuo Takahashi, Yokohama; Hajime Chikatani, Hachioji, all of Japan

[73] Assignee: Kabushiki Kaisha Daisei Kikai, Tokyo, Japan

[21] Appl. No.: 724,136

[22] Filed: Jul. 1, 1991

Related U.S. Application Data

[62] Division of Ser. No. 466,698, Dec. 6, 1989, Pat. No. 5,056,300.

[30] Foreign Application Priority Data

Dec. 6, 1988 [JP] Japan ..... 63-308394
Dec. 6, 1988 [JP] Japan ..... 63-308396

[51] Int. Cl.[5] ..... B65H 3/12; B65H 3/34

[52] U.S. Cl. ..... 271/95; 271/104

[58] Field of Search ..... 271/90, 94, 95, 104, 271/106, 121, 167

[56] References Cited

U.S. PATENT DOCUMENTS

| | | | |
|---|---|---|---|
| 3,174,260 | 3/1965 | Saumsiegle et al. | 53/189 |
| 3,339,338 | 9/1967 | Brinck et al. | 53/189 |
| 3,421,287 | 1/1969 | Sheets | 53/190 |
| 3,980,292 | 9/1976 | Sakurai | 271/95 |
| 4,345,629 | 8/1982 | Inglett Jr. | 141/114 |
| 4,359,216 | 11/1982 | Leonard | 271/95 |
| 4,381,168 | 4/1983 | Johnson et al. | 271/95 |
| 4,567,715 | 2/1986 | Sawa et al. | 53/572 |
| 4,664,161 | 5/1987 | Sawa et al. | 141/114 |
| 4,840,016 | 6/1989 | Muller et al. | 53/459 |

FOREIGN PATENT DOCUMENTS

| | | | |
|---|---|---|---|
| 565163 | 4/1923 | France | 271/95 |
| 2517629 | 12/1982 | France . | |
| 548489 | 9/1956 | Italy | 271/104 |

*Primary Examiner*—Robert P. Olszewski
*Assistant Examiner*—Steven M. Reiss
*Attorney, Agent, or Firm*—Oblon, Spivak, McClelland, Maier & Neustadt

[57] ABSTRACT

The present invention relates to a sheet picking-up device having a suction member for picking up an edge of a first sheet from a stack of sheets. The suction member having a suction aperture and a driving device for rotating the suction aperture of the suction member in a direction in which the suction aperture is upwardly directed so as to pick up the edge of the first sheet. The driving device further displaces the suction member to a position near the center of the first sheet.

2 Claims, 5 Drawing Sheets

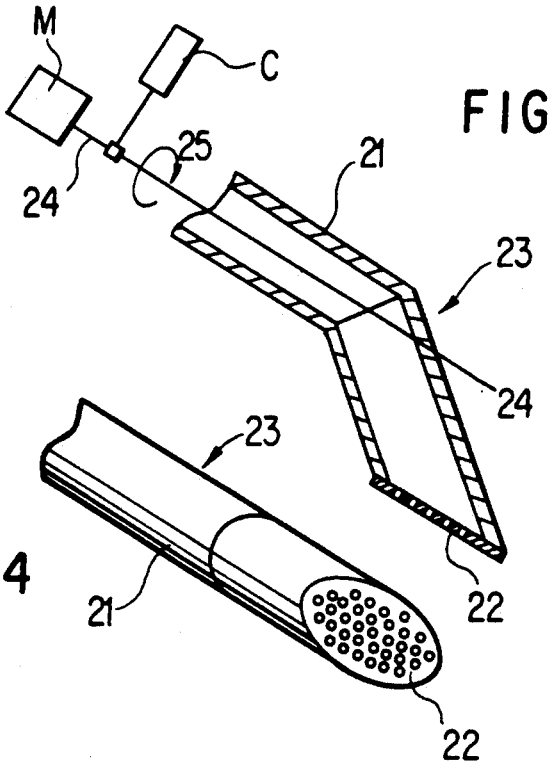
FIG.5
FIG.4
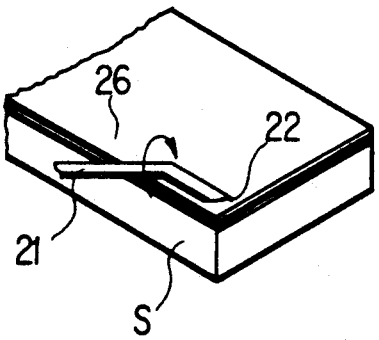
FIG.6a
FIG.6b
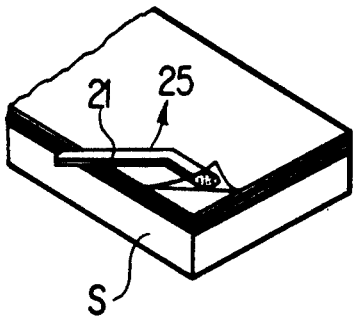
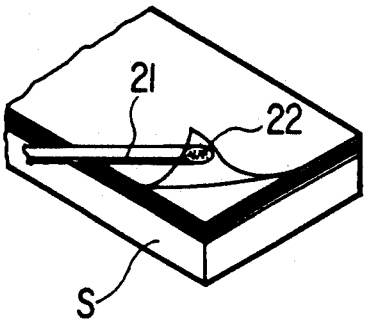
FIG.6c

SHEET PICKING-UP DEVICE

This is a division of application Ser. No. 07/446,698, filed on Dec. 6, 1989, and now U.S. Pat. No. 5,056,300, issued Oct. 15, 1991.

BACKGROUND OF THE INVENTION

The present invention relates to a bagging apparatus in which article-bagging is automatically carried out by opening the opening of stacked bags, for example plastic bags, and putting an article to be bagged into the opened bag, and to a bag opening device for article-bagging.

As an example of a conventional method for bagging an article into plastic bags automatically, there is given one using plastic bags in which the upper and lower sheets of their opening are composed in the form of a lidded envelope as shown in FIG. 8.

According to this conventional method, namely, article-bagging is carried out by placing such formed plastic bags 01 on a bagging apparatus, with a portal pin 03 put through their lid portion 02 as shown in FIG. 8, opening a bag, for instance by applying a jet of air 04 to its bag opening as shown in FIG. 9, and putting guide plates 05 into the thus-opened bag, pushing an article to be bagged into the bag along the guide plates 05 while the bag is drawn toward its bottom to tear off the lid portion of the bag out of its engagement with the pin 03 and then tightening the bag opening.

Goods bagged in such manner are apparently damaged and its commercial value is diminished, because the bag opening has a lid-shaped piece with broken holes, as shown in FIG. 10.

It is therefore an object of the present invention to provide a bagging apparatus capable of carrying out article-bagging in which such defects as in the above-mentioned prior art are eliminated, and a bag opening device, and another object of the present invention is to provide a bagging apparatus capable of smoothly opening even plastic bags in which two sheets on their opening are cut in a straight line in the laminated state, and of bagging an article thereinto automatically.

SUMMARY OF THE INVENTION

In the apparatus according to the present invention, one corner of the opening of an uppermost bag of stacked bags is picked up and a separator plate is inserted from the same corner between the uppermost bag and a next bag stacked thereunder, and then a touching member is brought from above into contact with the opening of the bag carried on the separator plate to slide the upper film of the bag opening toward the bottom of the bag, the thus-slidden upper edge is lifted to open the bag, and an article is pushed into the opened bag.

Even if bags are used which have an opening cut with no slide in the laminated state, the apparatus according to the invention can carry out article-bagging smoothly by sliding only the upper sheet of their bag opening and then lifting it to open the bag , as described above.

Also in the apparatus according to the present invention, one corner of the opening of an uppermost bag of stacked bags is picked up and a separator plate is inserted from the same corner between the uppermost bag and a next bag stacked thereunder, and then only the upper film of the opening of the bag carried on the separator plate is lifted by an opening means, thereby to open the bag automatically.

Furthermore, in the apparatus according to the present invention, a touching member which is brought from above into contact with the bag opening to slide the upper film of the bag opening, as described above, is used to facilitate the bag-opening action, and then a bag opening means for lifting the upper film of the bag opening is actuated, thereby to open the bag.

BRIEF DESCRIPTION OF THE DRAWINGS

FIG. 4 and FIG. 5 are a front elevational view and a sectional view showing the composition of a suction member, respectively.

FIGS. 6(*a*)–(*c*) are illustrative views showing the action of picking up the corner of a bag opening.

DESCRIPTION OF THE PREFERRED EMBODIMENTS

Figure 1:
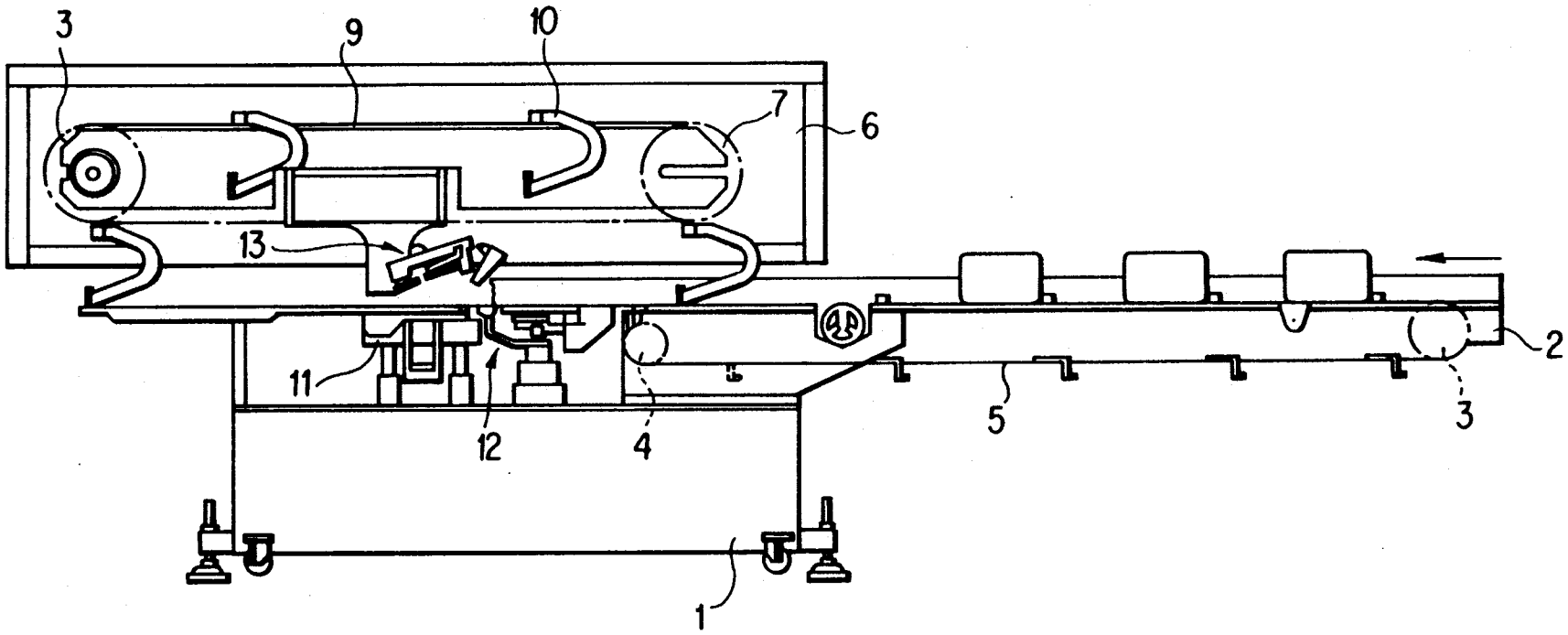
FIG. 1 is a side view of the apparatus according to the invention.

Referring to the illustrated embodiments, the present invention will be concretely described.

One embodiment of the bagging apparatus according to the invention, shown in FIG. 1, will be described below. The reference numeral 1 represents a machine base, on which a table 2 is arranged so as to be laterally extended.

On the table 2, an endless conveyor 5 is provided which is stretched round wheels 3 and 4. Articles to be bagged are being conveyed in the direction of an arrow from right to left on the drawing, by means of said conveyor 5.

A machine frame 6 is mounted over the machine base 1, and an endless chain 9 is stretched round a pair of wheels 7 and 8 in the machine frame 6.

The endless chain 9 has pusher devices 10 mounted thereon at a given interval. On the machine base 1, there are mounted a bag holding device 11 which holds plastic bags in a stacked state and a separator plate inserting device 12 for inserting a separator plate under the opening of an uppermost bag of plastic bags stacked in the bag holding device 11, as mentioned hereinafter.

In the machine frame 6, there is mounted, at a position just above the bag holding device 11, a bag opening device 13 for opening the opening of an uppermost bag of the plastic bags stacked in the bag holding device 11, as described in detail hereinafter.

The composition of the separator plate inserting device 12 will be described, with reference to FIG. 2 and FIG. 3.

The separator plate inserting device 12 has two arms 14 and 15, each of which is turned, and a separator plate 16 is attached on the fore end of each arm 14, 15, respectively.

The separator plate 16 has a plurality of apertures 17 formed thereon for drawing a film by vacuum. These apertures 17 are communicated with a proper suction device.

The arms 14 and 15 will be turned round a rotary shift 18 so that the separator plates 16 at their ends are alternately inserted under the opening of an uppermost bag of the stacked plastic bags.

The reference numerals 19 and 20 represent the corners of the openings of the stacked plastic bags S on both the sides, and the reference numeral 21 represents a hollow suction pipe formed with its fore end portion bent in the character of "<", which has a suction aperture portion 22 provided at its fore end, as shown in detail in FIG. 4 and FIG. 5. Corner picking-up suction members 23, each thus composed of the suction pipe 21 having the suction aperture portion 22, are arranged with their suction aperture portions 22 directed to the corners 19 and 20 on both the sides of the openings of the plastic bags S stacked as shown in FIGS. 2 and 3, and they will be alternately actuated.

The suction member 23 will be rotated round an axis shown by the line 24—24 in FIG. 5 in the direction of an arrow 25 so that its suction aperture portion 22 is directed upwards. This state is gradually shown in FIG. 6(1), (2) and (3).

On the other hand, the suction member 23 is gradually displaced near to the center of the plastic bags S, with the rotation, as shown by an arrow 26 in FIG. 6. By virtue of both the rotation and displacement, the uppermost bag or sheet whose one corner has been drawn by the suction aperture portion 22 is being gradually picked up from the same one corner.

Figure 2:
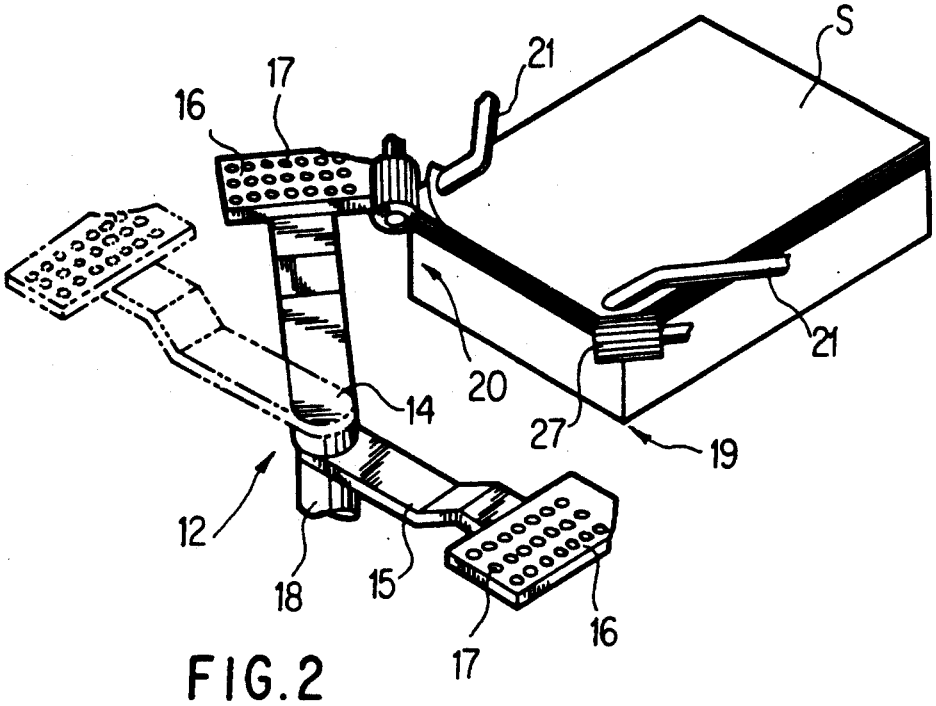
FIG. 2 and FIG. 3 are perspective views showing devices thereof for picking up one corner of the opening of a bag and separator plates.
Figure 3:
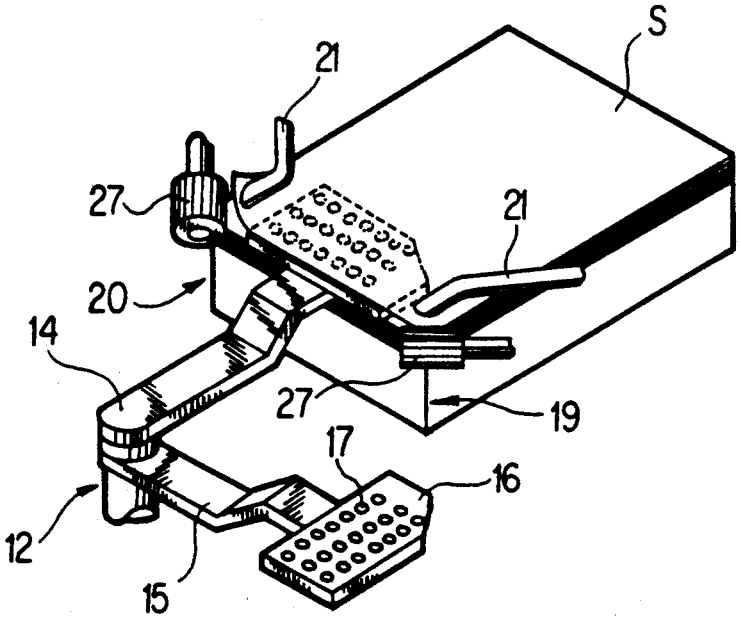
Figure 7A:
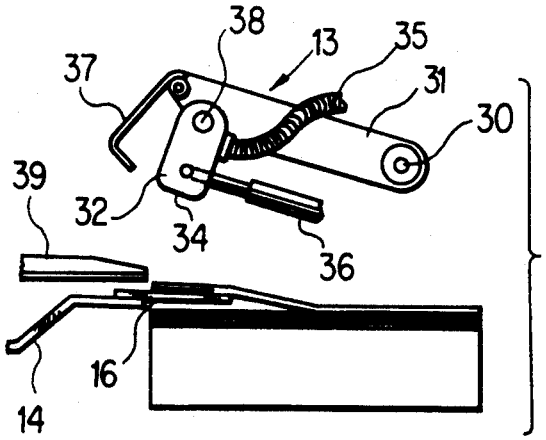
FIGS. 7(*a*)–(*e*) are views showing the composition and action of a bag opening device.
Figure 7B:
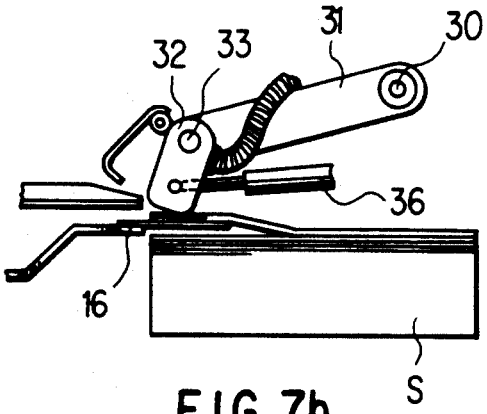
Figure 7D:
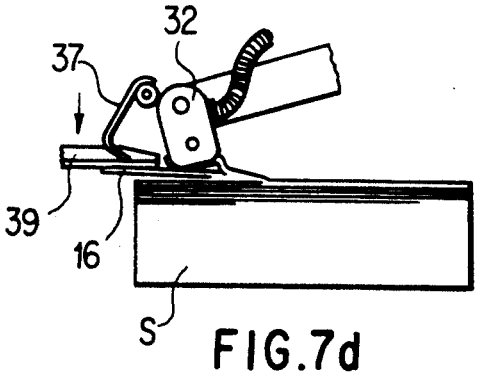
Figure 7C:
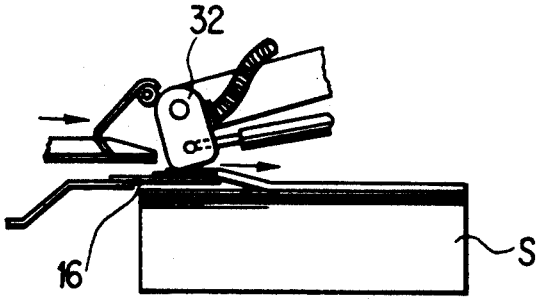
Figure 7E:
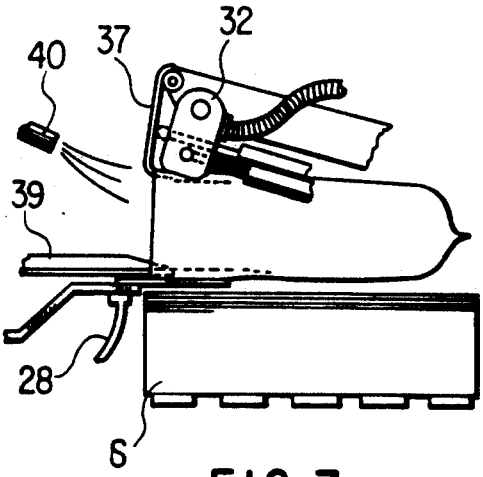
Figure 8:
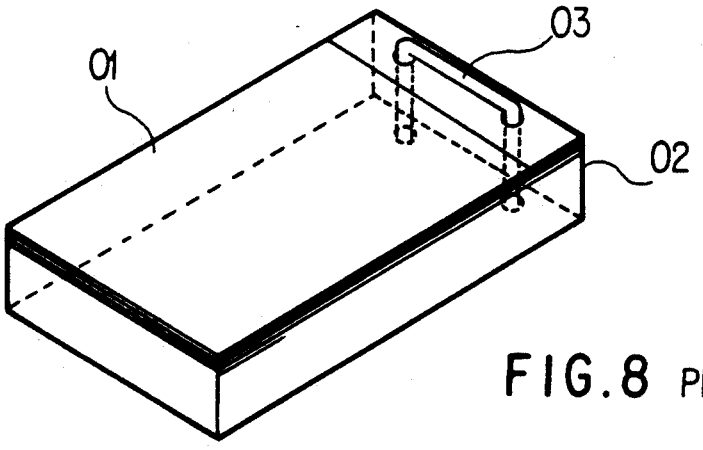
FIG. 8 PRIOR ART
FIG. 8 and FIG. 9 are a perspective view and a side view illustrative of a conventional apparatus, respectively.
Figure 9:
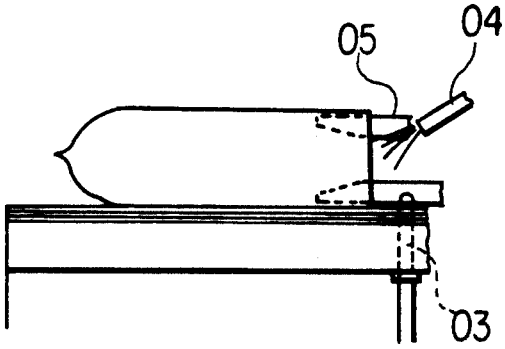
FIG. 9 PRIOR ART
Figure 10:
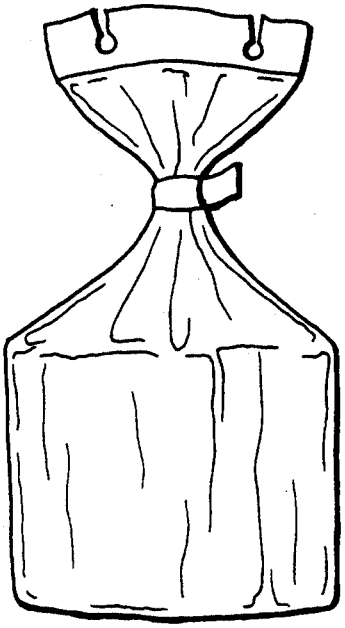
FIG. 10 is a perspective view showing one example of goods bagged by the conventional bagging apparatus.

In FIG. 2 and FIG. 3, the reference numeral 27 represents a bristle brush which is rotated as illustrated here. This bristle brush 27 serves to scrape down the bags, except the uppermost one, so that the bags drawn by the suction member 23 are steadily picked up one by one.

The rotation 25 of the said suction members 23 may be provided by a rotation given to their suction pipe 21 with a proper means, for example a motor M, and the displacement 26 of the suction members 23 can be given by a proper piston-cylinder C.

In addition, it is needless to say that another proper shape and structure may be adopted for the composition of the suction member 23, without limitting the illustrated one.

Thus, the uppermost bag is gradually picked up from its corner at the corner 19 or 20 of the stacked plastic bags, and the separator plate inserting device 12 is actuated from the picked-up corner, whereby the separator plate 16 is inserted between the uppermost bag and a next bag thereunder. This state is illustrated in FIG. 3.

When article-bagging is completed on an uppermost bag, the suction pipe 21 at the corner 19 starts to work secondly so as to pick up the corner of a next bag, and the separator plate 16 on the right side is then inserted as the separator plate 16 on the left side is returned to the original position, as described after.

At the next, the bag opening device 13 will be described in detail, referring to FIG. 7.

In FIG. 7, the relationship between the stacked plastic bags S and the separator plate 16 is illustrated in the same positional state as shown in FIG. 3. The bag opening device 13 is above the stacked plastic bags S, as in FIG. 7(1).

The bag opening device 13 has an arm 31 pivotally secured on the machine frame 6 by a pivot 30, and a touching member 32 is pivotally secured at 33 on the fore end of the arm 31. The under side 34 of the touching member 32 is formed as a face having suction apertures similarly to the suction aperture portion 22 of the suction member 23, to which vacuum is applied by way of a pipe 35.

The reference numeral 36 represents a piston-cylinder for turning the touching member 32 round a pivot 33.

A claw 37 is pivotally secured at 38 on the fore end of the arm 31 and may be turned round the pivot 38 by a proper means.

The reference numeral 28 in FIG. 7(5) represents a pipe for applying vacuum to the apertures 17 of the separator plate 16, and 40 represents a nozzle for blasting air toward the opening of a bag.

The bag opening device 13 thus composed as described above is brought into contact with the opening of a bag on the separator plate 16, as shown in FIG. 7(2), as its arm 13 is turned downward round the pivot 30 by a proper means.

Under that state, the upper plastic sheet of the bag is drawn to the apertures of the under side 34 of the touching member 32 by the suction therefrom. In succession, the piston-cylinder 36 is contracted to turn the touching member 32 round the pivot 33 in the direction of an arrow.

The upper film of the opening of the bag is being sucked on the under side 34 of the touching member 32, and when the touching member 32 is therefore turned to the state shown in FIG. 7(3), the upper film of the opening of the bag is moved together with the touching member 32, while the under film thereof is sucked on the separator plate 16 and left as it is at that position, with the turning of the touching member 32, whereby the upper and lower films of the bag opening are slidden from each other.

Under that state, a bottom plate 39 is caused to get near to the opening of the bag by a proper means and to ride onto the lower film of the bag opening. This state is illustrated in FIG. 7(4).

Then, the claw 37 is turned round the pivot 38 by a proper means and its fore end is caused to get into between the slidden upper and lower sheets of the bag opening.

When the arm 31 of the bag opening device 13 is set up after that, the upper sheet of the opening of the bag is drawn by the vacuum of the touching member 32 and it is further hooked and lifted by the claw 37. Thus, the opening of the bag is expanded as shown in FIG. 7(5).

Furthermore, the bag is wide opened like a streamer by means of a jet stream from a nozzle 40.

In such a state that the bag is opened and left as it is, an article which is being conveyed by the conveyor 5 as shown in FIG. 1 is made to collide with the pusher device 10 which is being moved with the travel or the chain 9, and it is caused to travel together with the pusher device 10. Thus, the article is caused to slip on the bottom plate 39 into the bag which has been opened like a streamer as described above. After that, the suction of the sheets of the bag opening by the separator plate 16 and the touching member 23 is released and the bag is conveyed to a discharg side by the pusher device 10 as it contains the article.

Namely, "clear bagging" in which the bag opening left after tightening is not damaged, differently from the prior arts, can be automatically carried out by repeating the above-mentioned operation to conduct the article-bagging in turn.

Although two separator plates 16 are arranged for alternate use in the apparatus which has been concretely described, there may be added various modifications, for instance an arrangement of one separator plate or an arrangement of three or more separator plates which will be rotated in one direction for use in turn.

For the separator plate 16, in addition, the vacuum type one has been described. However, various types of separator plates may be used, if they can hold the lower film of a bag opening to prevent it from slipping. For instance, there may be used a separator plate made of rubber hard to slip or material whose surface is adhesive, and such a vaccum type separator plate is therefore not necessarily used.

Concerning the touching member 32, the vacuum type one has been also adopted. Such a vacuum type touching member is not always adopted, if a touching member is made up of rubber hard to slip or material whose surface is adhesive, as well as the separator plate described above.

As illustrated in the drawings, the claw 37 which hooks the upper sheet of a bag opening has been adopted in addition to the vacuum type touching member. In case a vacuum type touching member is used, however, it is possible to lift the upper sheet of a bag opening by means of only the touching member so that the bag is opened, without using such a claw.

The illustrated touching member 32 has been shown as one of sliding the upper sheet of a bag opening by its swinging motion. However, a touching member may be composed as one which slides the upper sheet merely by its horizontal displacement. For the pusher device 10, furthermore, there may be adopted these different in shape and structure.

In the apparatus according to the present invention, as has been described above, one corner of the opening of an uppermost bag of stacked bag is picked up and a separator plate is inserted from the same corner between the uppermost bag and a next bag stacked thereunder, and then a touching member is brought from above into contact with the opening of the bag carried on the separator plate to slide the upper film of the bag opening toward the bottom of the bag, and the thus-slidden upper egde is lifted to open the bag, and then an article is pushed into the bag.

Even if bags are used which have an opening cut arrangedly in a straight line in the laminated state, the apparatus accoding to the present invention is capable of opening the bags one by one steadily, and carrying out smooth article-bagging automatically, as described above.

According to the present invention, there is also provided an apparatus in which films, except the upper film of the opening of an uppermost bag are restrained by a separator plate inserted between the uppermost bag and a next bag stacked thereunder, and only the upper film is lift by an opening means, thereby to open the bag automatically and smoothly.

According to the invention, there is further provided an apparatus in which the article-bagging, the opening action of a bag-opening means is facilitated by sliding the upper sheet of its bag opening by means of a touching member.

What we claim is:

1. A sheet picking up device comprising:

a suction member for picking up an edge of a first sheet from a stack of sheets, said suction member comprising a suction aperture portion which is directed to one corner of said stack of sheets; and a driving device for rotating said suction aperture portion of said suction member to a position in which said suction aperture portion is upwardly directed so as to pick up the edge of said first sheet and displacing the suction member to a position near the center of said first sheet so as to move said picked up edge of said first sheet to the center of said first sheet;

wherein said suction member comprises an axis which intersects a side edge of said stack of sheets such that an extension of said axis intersects a front edge of said stack of sheets; and said driving device rotates said suction member about said axis and displaces said suction member toward the center of said picked up first sheet along a line which intersects said axis and is parallel to a surface of the picked up first sheet.

2. A sheet picking-up device, as claimed in claim 1, further comprising a rotary brush arranged at one corner of the stacked sheets for sweeping down the corner of the stacked sheets in a downward direction.

* * * * *